United States Patent [19]

Hayes

[11] Patent Number: 4,801,059

[45] Date of Patent: Jan. 31, 1989

[54] POCKET CALCULATOR HOLDER

[76] Inventor: Leonard E. Hayes, 156 Grambling Ct., Westwego, La. 70094

[21] Appl. No.: 121,121

[22] Filed: Nov. 16, 1987

[51] Int. Cl.[4] ..... B65D 33/10

[52] U.S. Cl. ..... 224/240; 224/236; 224/151; 224/202; 224/253; 190/116; 150/110; 150/117

[58] Field of Search ..... 224/151, 201, 202, 205, 224/253, 240, 237, 235, 236, 257; 190/115, 116; 150/110, 117

[56] References Cited

U.S. PATENT DOCUMENTS

| | | | |
|---|---|---|---|
| 1,648,565 | 11/1927 | Primley | 224/240 |
| 1,895,074 | 1/1933 | Hagerstrom | 224/240 |
| 3,552,610 | 1/1971 | Coleman | 224/240 |
| 4,515,300 | 5/1985 | Cohen | 224/253 |

*Primary Examiner*—Henry J. Recla
*Assistant Examiner*—Linda J. Sholl
*Attorney, Agent, or Firm*—Keaty & Keaty

[57] ABSTRACT

A pocket calculator holder for selectively detachably securing the holder to a waist belt of a user or to a shoulder strap provides for the use of a holder body having a closed bottom, closed sides and an open top. The holder body is secured to the shoulder strap or to a wearer's belt through the use of a pair of spaced-apart strips attached to the back portion of the holder body. One of the ends of the strips is securedly attached to the back portion of the holder body, while the second end is provided with a fastener element to fasten with a co-aligned mating fastener element attached to the back portion of the holder body. The second embodiment provides for the use of a pair of spaced apart strips mounted on an underside of a flap which is securedly attached to a back portion of the holder body. The strips on the underside of the flap form loops with the underside of the flap for receiving a shoulder strap therein. A waist belt securing means of the second embodiment provide for the use of a pair of spaced-apart strips securedly attached at least at one of their ends to the back portion of the holder body.

6 Claims, 3 Drawing Sheets

POCKET CALCULATOR HOLDER

BACKGROUND OF THE INVENTION

Field of the Invention

The present invention relates to a holder for carrying such items as calculators, note pads and the like and more specifically, to a holder suitable for carrying items which can be secured to a belt of a user or suspended by a shoulder strap.

It is often necessary to bring a calculator, a note pad and writing instruments to a job site, for example, at construction sites, or while taking inventory in a store, so that the calculator and note pad are readily accessible, while hands of the user are free to do the necessary work when not utilizing the calculator and the note pad. Also, it is useful to have one holder which would house a calculator and/or note pad, as well as writing instruments.

There are known various holders for such articles as knives, ammunition for hunting or skinning, fishing assessories, and the like. They are generally designed to be worn with a belt and provide suitable pockets for carrying the necessary articles, some of such holders can be attached to a user's belt, after which the belt is put on the user's waist.

However, sometimes it is more convenient to wear the article holder on a shoulder strap than attached to the belt or it becomes more convenient to readily attach the holder to the belt without taking the belt off, which saves time and trouble to the user.

It is therefore an object of the present invention to provide a multi-purpose holder for carrying a calculator, note pad and writing instruments, the holder being adapted for attachment to either a shoulder strap or to a waist belt of a user.

It is another object of the present invention to provide separate holders for a calculator and a note pad which can be used alone or in combination with one another by either securing them on a shoulder strap or about a waist belt of a wearer.

It is another object of the present invention to provide a holder which is adapted to carrying writing instruments in close proximity to the note pad and/or calculator, such that the hands of the wearer are left free to perform a required task without being encumbered by articles, while retaining these articles in an accessible position.

It is a further object of the present invention to provide a holder which can be easily attached to a user's belt without having to unfasten and take off the belt to secure the holder on the belt. Further objects and features of the present invention will be more readily understood from the following description of the present invention.

SUMMARY OF THE INVENTION

The present invention solves the problems of the prior art and achieves its objects in a simple and straightforward manner.

A pocket calculator holder is provided which comprises a holder body having a front portion and a back portion securedly attached to each other to form a pocket having a closed bottom, closed sides and an open top.

Securing means for selectively securing the holder body to a waist belt of a user or to a shoulder strap are attached, in one embodiment of the invention, to the back portion of the holder body. The securing means can be in the form of a pair of spaced apart strips, each forming a loop (or simply by flat strips), with portion of the holder body, and fastened, for example, with the use of snaps, to the back portion of the holder body at the loop's lower end. When positioning the holder body on the user's belt, the snaps are unfastened and the loops are passed over the belt, so that their lower ends extend below the belt and meet with the fastener snaps attached to the back portion of the holder body. By fastening the snaps, the holder body is securedly attached to the waist belt of a wearer. There is no necessity to unfasten the belt itself prior to positioning the holder body on the waist belt of a user.

Alternatively, a shoulder strap can be passed through the loops and suspended from the shoulder of a wearer if such mode of utilizing the holder is found to be more convenient for the particular situation.

A second embodiment of the present invention provides for the use of a holder body having a closed bottom, closed sides and open top which can be selectively secured to the waist belt of a wearer or to a shoulder strap. The securing means for the shoulder strap are provided on an underside of a flap which is unitary or otherwise securedly attached to the back portion of a holder body. The securing means can be in the form of spaced-apart strips attached at their ends to the underside of the flap to form a loop between the strips and the underside of the flap. A shoulder strap is then passed through the loops and suspended from the shoulder. Alternative positioning of the holder body of the second embodiment of the present invention to the waist belt of a wearer can be achieved through the use of other securing means attached to the back portion of the holder body. These securing means can be made in the form of a pair of spaced-apart strips attached at their upper and lower ends to the holder body to form loops between the strips and the back portion of the holder, so that a waist belt can be passed through the loops and the holder body is secured on the waist belt. Similarly to the first embodiment of the present invention, a snap fastener can be provided on each of the strips attached to the back portion and a co-aligned, mating fastener element can be attached to the back portion, so that positioning of the holder body on the waist belt is made easier.

The holder bodies of the first and second embodiments can be utilized alone or in combination with each other by either securing one of them to a waist belt and the other one to the shoulder strap, or by securing both of them to a shoulder strap and suspending them on one shoulder.

Secondary pockets can be made on the holder body to house miscellaneous items or writing instruments.

The pocket calculator holders of the present invention provide an inexpensive, easily securable means for carrying a calculator and/or note pad and/or writing instruments to a job site, while freeing hands of the user for performing other necessary tasks.

DETAILED DESCRIPTION OF THE PREFERRED EMBODIMENT

Figure 2:
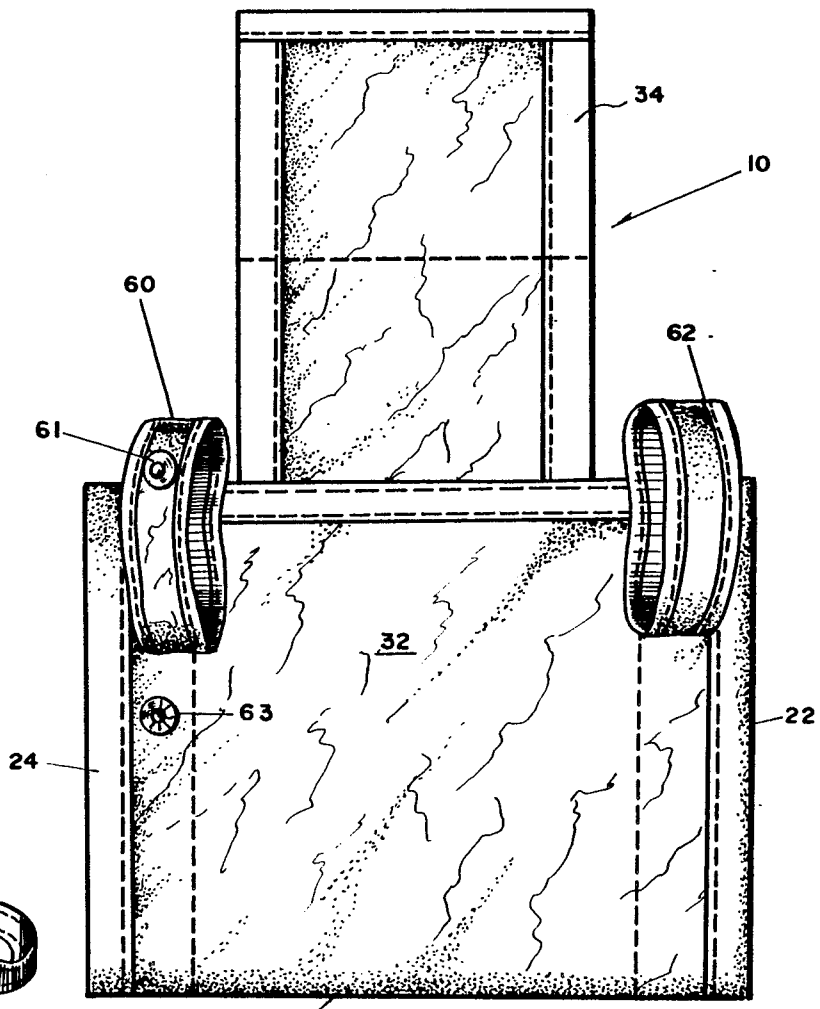
FIG. 2 is a rear view of the holder shown in FIG. 1.
Figure 1:
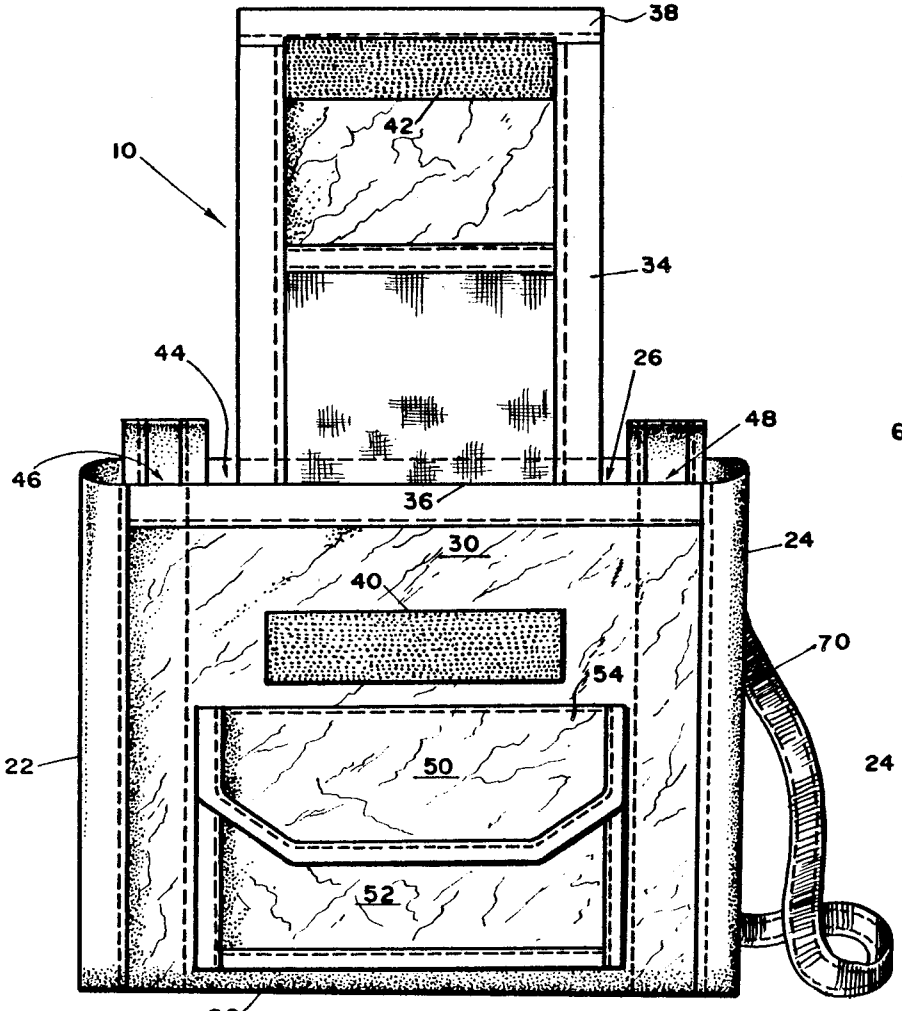
FIG. 1 is a front view of a pocket calculator holder in accordance with the first embodiment of the present invention.

Referring now to the drawings, and in particular to FIGS. 1 and 2, there is shown a first embodiment of the present invention, wherein the holder is designated by the reference numeral 10. The holder body 10 is of a generally flat, rectilinear configuration, and has a closed bottom 20, closed sides 22 and 24 and an open top 26.

The holder 10 has a front portion 30 and a back portion 32 secured in a generally parallel relationship to each other. Flap 34 is securedly attached to the back portion 32 in such a manner that its longitudinal edges are spaced equidistantly from the ends 24 and 22 of the holder 10. The flap 34 is conveniently sized to be folded forward and cover at least the central portion of the open end 26, while extending downwardly from the top edge 36 of the holder 10. A suitable closing means, such as a strip of hook and loop fasteners, can be positioned adjacent a top end 38 of the flap 34 and a mating fastener strip 40 can be attached a distance from the edge 36 of the holder 10 on the front portion 30 of the holder. The strip 40 is generally of the same width and length as the strip 42 attached to the flap 34, so that the flap 34 can be closed by bending it forward and downward, thus at least in part overlapping the front portion 30. The hook and loop fasteners can be alternatively substituted by any other fastening elements, such as snaps and the like, if need be.

A central portion of the holder 10 forms a pocket 44 sized and adapted to house a calculator or a note pad. A pair of side pockets 46 and 48 are formed between the front portion 30 and the back portion 32 by stitching these portions together at a distance from the ends 22 and 24 of the holder body 20. The pockets 46 and 48 are sized and adapted to house writing instruments, such as pens and pencils, and retain them is close proximity to a calculator and/or note pad. As can be seen in FIG. 1, the pockets 46 and 48 are of substantially similar vertical dimensions as the central pocket 44, although the width of the pockets 46 and 48 is substantially smaller than the width of the pocket 44.

A secondary pocket means 50 is securedly attached to the front portion 30 of the holder body 10, the pocket 50 being of a rectilinear configuration and comprising a front panel 52 and a flap 54. The pocket 52 has a closed bottom, closed sides and an open top (not shown) which is covered by a flap 54 to prevent objects housed in the pocket 50 from falling out of the pocket.

The flap 54 can be secured to the front portion 52 by suitable fastening elements, such as, for example, hook and loop fasteners or snaps. The front portion 30 of the holder body 20 serves as the back portion of the pocket 50. The back portion 32 of the holder body 10 is provided with a pair of securing means forming loops 60 and 62, which are fixedly attached to the back portion at least at the upper parts of the loops. The lower parts of the loops can be attached by, for example, snaps 61, 63 (only one of each is shown), to the back portion 32 so that the loops 60 and 62 can be secured to the belt 200 of a wearer and snapped in place, preventing disengagement of the holder 10 from the belt 200. In this case, the user does not have to unfasten his belt. He merely guides the loops 60 and 62 behind the belt 200 so that the ends of the loops having snaps extend below the belt. Then the snaps 61 on the loops 60 and 62 are fastened with the mating snaps 63 attached to the back portion 32 at appropriate places, thus securing the holder 10 to the user's belt. Release of the holder 10 can be easily accomplished by simply unfastening the snaps and withdrawing the loops 60 and 62 from their positions behind the user's belt 200.

Figure 8:
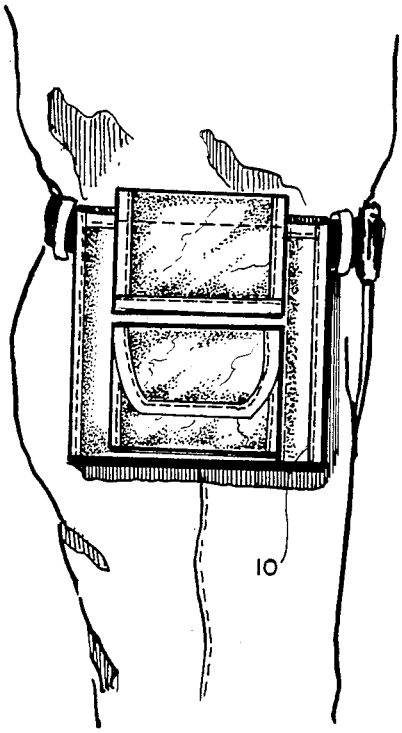
FIG. 8 illustrates the mode of wearing of the holder in accordance with the first embodiment of the present invention secured to a belt of a user.

FIG. 8 illustrates the use of the holder 10 as secured to the belt 200 of the wearer.

Figure 7:
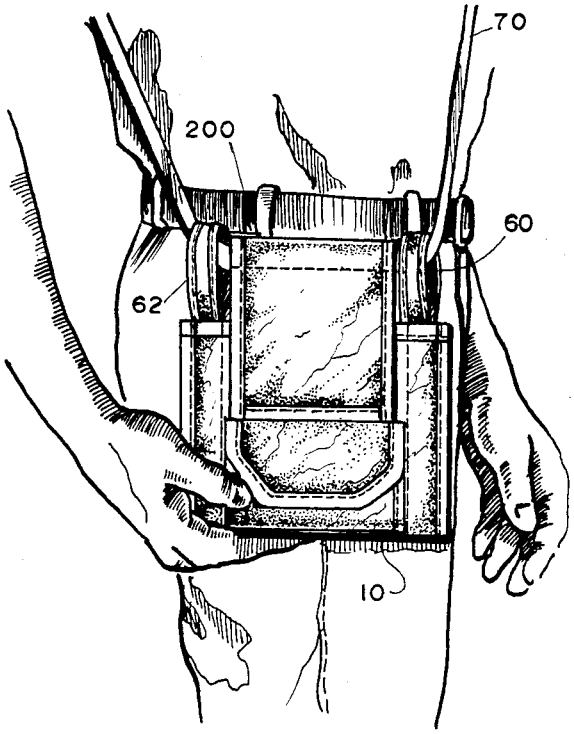
FIG. 7 illustrates the mode of use of the holder in accordance with the- first embodiment of the present invention suspended on a shoulder strap.

Alternatively, the loops 60 and 62 can be utilized for receiving a shoulder strap 70 therethrough, so that the holder 10 can be worn suspended from the shoulder as can be seen in FIG. 7. The shoulder strap 70 is allowed to pass through the loops 60 and 62, along the back portion 32 of the holder 10 and be suspended from a shoulder of a wearer.

The holder 10 can be made of a flexible easily foldable material, such as vinyl, leather and the like.

Figure 4:
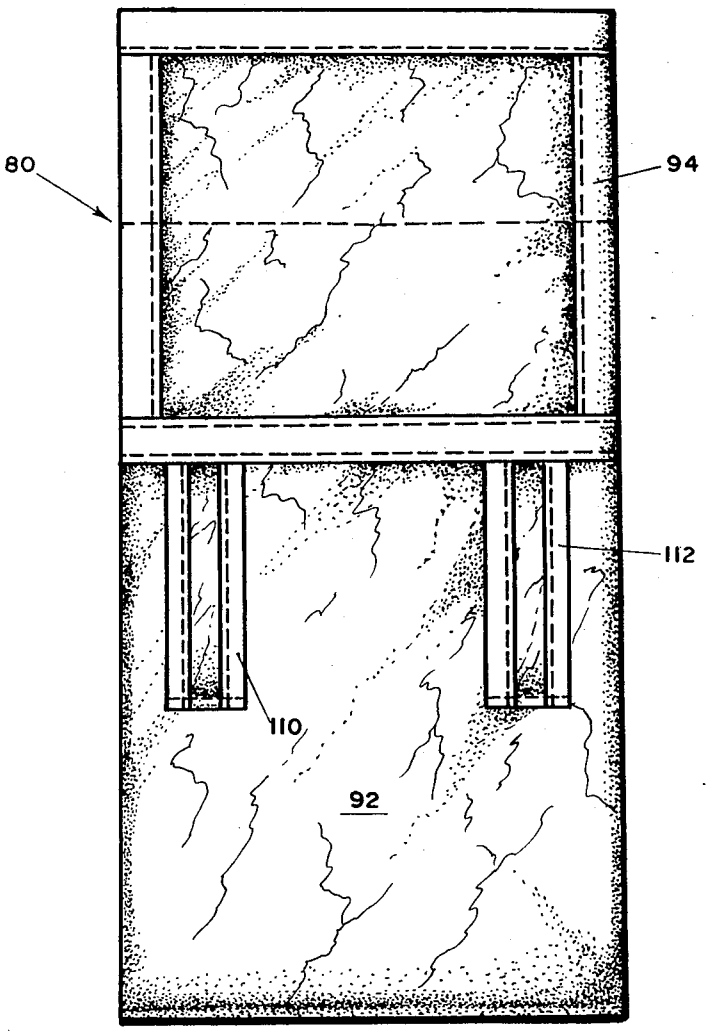
FIG. 4 is a rear view of the holder shown in FIG. 3.
Figure 3:
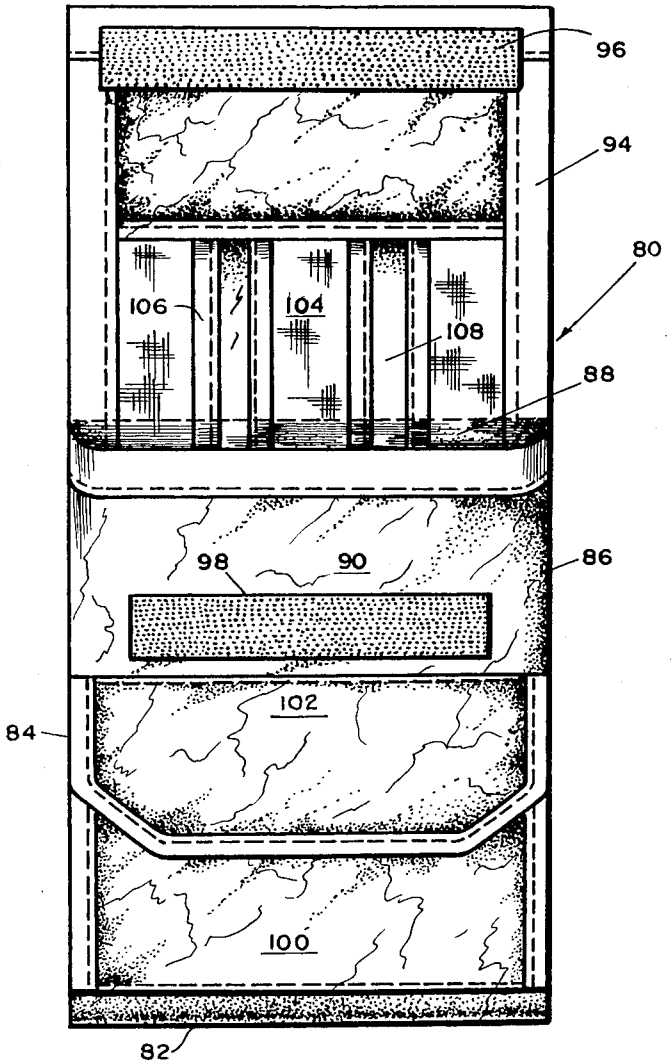
FIG. 3 is a front view of a second embodiment of the calculator holder in accordance with the present invention.

FIGS. 3 and 4 illustrate the second embodiment of the present invention, wherein numeral 80 designates the pocket calculator holder. The holder 80 is of a substantially flat, rectilinear configuration but is somewhat narrower in width and longer in dimensions than the holder 10. The holder 80 has a closed bottom 82, closed sides 84 and 86 and an open top 88 to receive a calculator or a note pad therein. The holder 80 has a front portion 90 and a back portion 92 which are secured in substantially parallel relationship to each other by, for example, stitching along sides 84 and 86, while the bottom 82 is formed by folding a rectangular flat piece of flexible material in half. A flap 94 is securedly atached to the flap portion 92 by, for example, stitching, although it can be unitarily connected to the back portion 92 and adapted to be folded down and over the open top 88 of the holder 80. Adjacent a top part of the flap 94, there is provided a strip of fastening material 96 for securing the flap 94 in a closed relationship over the open top 88 through the use of a mating securing means 98 attached to the front part 90 of the holder 80. The securing means 96 and 98 can be made in the form of hook and loop fastener elements or in the form of snaps, if so desired.

A secondary pocket 100 is formed on the front portion 90 of the holder 80, with the back of the pocket being formed by a part of the front portion 90. A suitable flap 102 is secured above the upper edge (not shown) of the pocket 100 and overlaps the edge, depending downwardly to cover an open top end of the pocket 100. The pocket 100 is designed to house various miscellaneous items.

Figure 5:
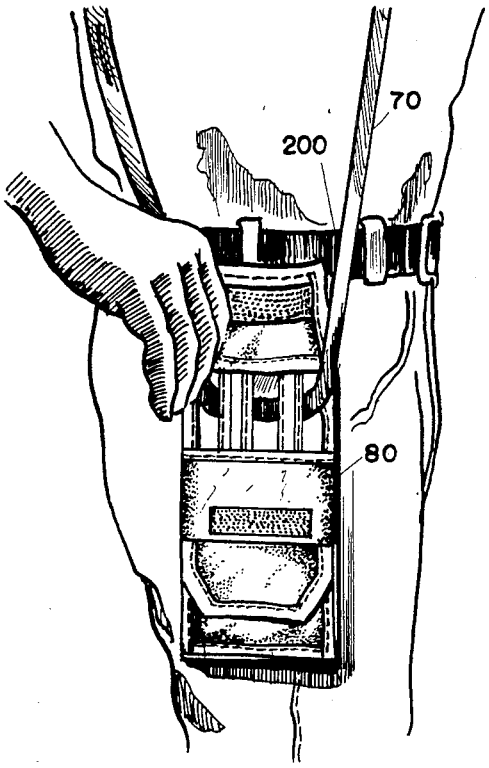
FIG. 5 illustrates the mode of wearing of the calculator holder shown in FIG. 3 with the use of a shoulder strap, with a flap open.
Figure 6:
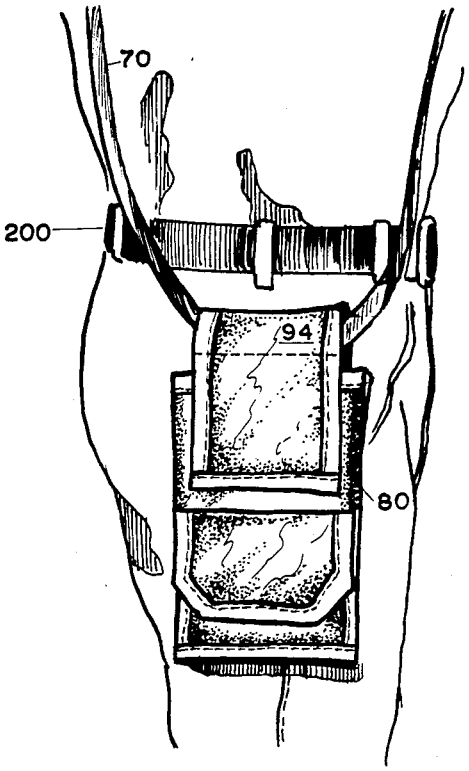
FIG. 6 illustrates the manner of use of the holder shown in FIG. 5, with the flap closed.

A shoulder strap securing means are positioned on the back side 104 of the flap 94, this securing means comprising a pair of bands 106 and 108 secured at their top and bottom ends to the underside 104 of the flap 94. When in use, the flap 94 is lifted and a shoulder strap 70 is passed behind the elements 106 and 108 as can be better seen in FIG. 5. A flap 94 is then folded down, over an open end 88 of the holder 80 and secured to the front part 90 of the holder 80 through the use of mating fastening elements 96 and 98. This arrangement is better seen in FIG. 6 of the drawings. In this manner, when contents of the holder 80 need to be retrieved the flap 94 is simply lifted, while the holder 80 remains suspended from the shoulder strap 70.

The holder 80 can be alternatively attached to a belt 200 of a wearer and to this end, the present invention provides for the use of a pair of flexible strips 110 and 112 secured along their top and bottom ends to the back portion 92 of the holder 80. The strips 110 and 112 are conveniently sized to allow a belt of the wearer to be passed through them between the underside of the strips 112 and the back portion 92 of the holder 80. Alternatively, a pair of securing elements (not shown) can be attached to either the bottom or top ends of the strips 110 and 112 to meet with the mating fastening element attached to the back portion 92. In this manner, the fastener can be unfastened and the strip 110 and 112 passed over the belt of a wearer and thereupon secured by fastening them with mating fasteners attached to the back portion 92, similar to the mode in which the holder 10 is attached to the belt 200.

Another alternative positioning of the holders 10 and 80 can be easily arranged by securing one of the holders to the belt 200, while allowing the second holder to be suspended from a shoulder by a shoulder strap 70.

Still, another alternative use can be achieved by suspending both of the holders on a shoulder strap and positioning the holder 80, for example, behind the holder 10 so that contents of the holders 10 and 80 can be easily reached, while allowing hands of a wearer to h=free for conducting other necessary tasks.

The holder 80, similar to the holder 10, can be made from a flexible material, such vinyl, leather and the like.

Alternatively, only one of securing means 44 or 48, 106 or 108, 110 or 112 can be used. In this case, the securing means can be centrally located to insure a proper balance.

It should be also understood that the number of pockets can be varied depending on the particular applications, and other possible embodiments of the invention can be made without departing from the spirit thereof.

I therefore pray that my rights in the invention be limited only by the scope of the following claims.

I claim:

1. A pocket calculator holder, comprising:

a front portion and a back portion securedly attached to each other to form a holder body having a closed bottom, closed sides and an open top;

a securing means for detachably securing said holder body to a shoulder strap; and a flap closing means securely attached to said back portion and adapted to be folded in covering relationship over at least a part of said open, top wherein said securing means comprises at least one strip securedly attached at its ends to underside of said flap closing means and forming a loop therewith for receiving the shoulder strap.

2. The device of claim 1, further comprising a secondary securing means for detachably securing said holder body to a user's belt.

3. The device of claim 2, wherein said secondary securing means comprise at least one strip attached at its ends to the back portion of the holder body to form a loop therewith.

4. The device of claim 3, wherein said holder body comprises a secondary pocket means formed on the front portion of the holder body.

5. The device of claim 4, further comprising a secondary flap closing means for closing the secondary pocket means by folding over its open top.

6. A pocket calculator holder, comprising:

a holder body formed by a substantially flat front portion and substantially flat back portion, forming a pocket with a closed bottom, closed sides and an open top;

a flap means securedly attached along one of its ends to the back portion of the holder body and adapted to cover in overlapping relationship at least a part of the open top of the holder body, said flap means having an underside;

a securing means for suspending the holder body from a shoulder strap, said securing means comprising a pair of spaced-apart strips securedly attached at their ends to the underside of the flap means and forming loops between the strips and the underside of the flap means for receiving a shoulder strap through the loops; and securing means for positioning the holder body on the user's belt, said securing means comprising a pair of spaced-apart strips, each secured at least at one of its ends to the back portion of the holder body and detachably secured by fastening elements at its other end to the back portion of the holder body.

* * * * *